United States Patent [19]

Scott

[11] 4,322,927

[45] Apr. 6, 1982

[54] METHOD OF MAKING STAIRCASES AND STAIRCASE MADE THEREBY

[75] Inventor: Kenneth E. Scott, Rangiora, New Zealand

[73] Assignee: Kenscot Industries Limited, Canterbury, New Zealand

[21] Appl. No.: 71,924

[22] Filed: Sep. 4, 1979

[30] Foreign Application Priority Data

Sep. 25, 1978 [NZ] New Zealand ..... 188525

[51] Int. Cl.[3] ..... E04F 11/00

[52] U.S. Cl. ..... 52/188; 52/191; 144/136 B; 144/309 L; 144/318

[58] Field of Search ..... 144/136 B, 309 R, 309 L, 144/318; 52/188, 191

[56] References Cited

FOREIGN PATENT DOCUMENTS 599115 3/1948 United Kingdom .
765986 1/1957 United Kingdom .
941178 11/1963 United Kingdom .
1100941 1/1968 United Kingdom .

*Primary Examiner*—W. D. Bray
*Attorney, Agent, or Firm*—Holman & Stern

[57] ABSTRACT

A method of making a closed-tread staircase, and of making steps for such a staircase. The tread and riser of each step are each made from a rebated, grooved slab; the rebates on tread and riser are mated to form a joint, which is secured by a joining strip of 'V'-shaped cross-section formed with flanges which are forced into the slab grooves. Steps are joined together in the same manner, and a staircase formed by supporting a series of steps upon two or more stair carriages, each carriage comprising a stringer with a series of spaced cleats secured to one side. Each cleat provides a horizontal tread-supporting portion and a vertical riser-supporting portion. Each stair carriage may be made using apparatus which provides means for supporting and indexing a stringer and supporting each cleat at a predetermined angle while cleat and stringer are secured together.

15 Claims, 7 Drawing Figures

Figure 2
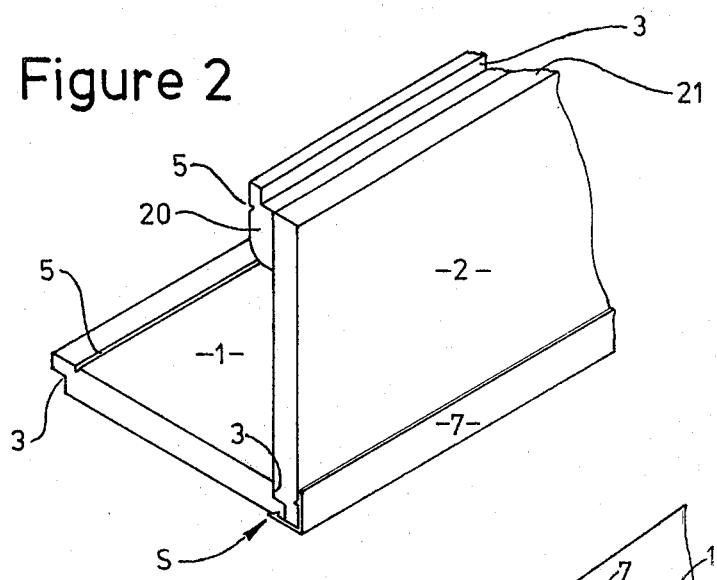
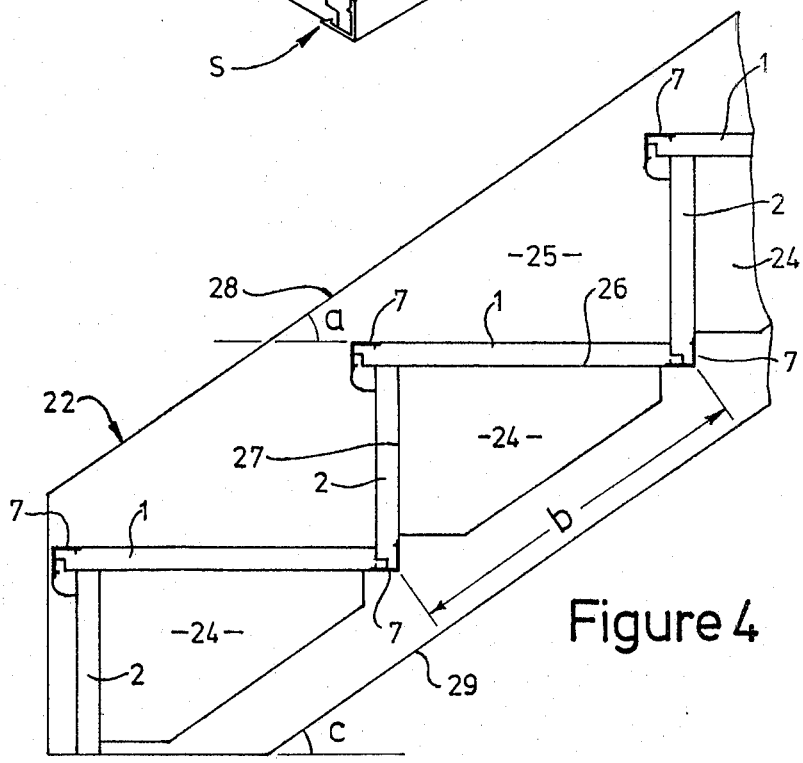
Figure 4

METHOD OF MAKING STAIRCASES AND STAIRCASE MADE THEREBY

FIELD OF THE INVENTION

The present invention relates to a method of making closed-tread staircases and steps for such staircases and to staircases made by this method. The method of the present invention has been developed primarily for staircases made of wood or wood-based materials (e.g. fibreboard) but could also be applied to staircases of other suitable materials (e.g. synthetic wood-substitutes or metals).

DESCRIPTION OF THE PRIOR ART

Generally, closed-tread wooden staircases are made by cutting a series of boards to form treads and risers, joining each pair of treads and risers (e.g. by tongue-and-groove joints) to form individual steps, and supporting the steps upon two or more stair carriages. A stair carriage is placed at each side of the steps and if the steps are more than about 1 meter wide, intermediate carriages are used as necessary. Each carriage provides a series of spaced horizontal seatings for the treads, and may be formed either by a board cut to the necessary stepped profile (termed a 'rough carriage') and used alone or in combination with a notched or finish stringer; or by a housed stringer, in which the stringer is grooved to house and support the edges of each tread and riser. The treads and risers are nailed to a rough carriage or wedged, glued and nailed to a housed stringer.

The above-described methods have been used for many years, and provide strong, secure staircases suitable for a wide range of uses. However, these methods involve a great deal of skilled labour and favour on-site construction rather than factory mass-production. An object of the present invention, therefore, is the provision of a method of making a step and a staircase which is as strong and as secure as those made by traditional methods but which require little or no skilled labour to assemble and can be mass produced economically.

BRIEF SUMMARY OF THE INVENTION

The present invention provides a method of making a step for a closed-tread staircase including the steps of:

(1) providing a slab for the tread and a slab for the riser, each slab having formed thereon: a first rebate across the width of one face of the slab, along one edge of said slab; a second rebate across the width of the other face of the slab, along the opposite edge of said slab; a first groove parallel to and adjacent said one edge on said other face of the slab; and a second groove parallel to and adjacent said opposite edge on said one face of the slab;

(2) forming a step comprising a tread and riser pair, said pair being formed by mating one of the rebates on one slab with one of the rebates on the other slab to form a joint, said rebates being shaped and dimensioned such that the mated rebates fit closely to form a joint of predetermined angle;

(3) providing a joining strip which is V-shaped in cross section and comprises two sides, each formed with a flange adjacent the free end thereof on the inside of the 'V', each said flange standing proud of the plane of the corresponding side and the angle between said flange and the plane of said corresponding side being equal to or less than 90°;

(4) securing said joint with said joining strip by engaging the flange on one side of the joining strip with the groove adjacent one side of the joint and forcing the flange on the other side of the joining strip into engagement with the groove adjacent the other side of the joint; the angle between the two sides of the joining strip when said strip is engaged with the joint being equal to the angle of the joint.

The angle of the joint between tread and riser commonly is 90° but may be less than or greater than 90°. The rebates on tread and riser are formed to an angle such that when said rebates are mated, the angle between tread and riser is the desired angle. If the joint angle is 90°, the rebates generally are formed with sides at 90°, but this is not essential: the sides of the rebates can be cut to any desired angle providing that when the rebates are mated the completed joint is a rightangle.

The tread and riser slabs may be rectangular in plan (for a straight-run staircase) or the tread may be formed as a winder (for a curved or spiral staircase).

Preferably, the riser is formed by carrying out the following additional steps between steps 1 and 2 above:

(1a) removing from an edge of the riser a strip wide enough to include the rebate and the groove adjacent said edge;

(1b) securing said strip to the non-grooved face of the slab along the edge from which the strip has been removed, such that the surface of the rebate on the strip is flush with said edge.

The present invention further provides a method of making a closed-tread staircase including the steps of:

(1) forming a plurality of steps by the method of steps 1–4 above;

(2) joining said steps together to form a series of steps by mating the rebate at the free end of a tread of one step with the rebate at the free end of a riser of another step to form a joint of predetermined angle, and securing said joint with a joining strip in the manner of step 4 above.

Preferably each stair carriage comprises a stringer with a series of cleats secured to one surface thereof, said cleats being spaced apart so that one cleat corresponds to each step, and each cleat providing a horizontal and a vertical support surface to support the edge of a tread and a riser respectively.

Preferably the angle guide also provides a second guide face perpendicular to the first, and said angle guide is mounted on parallelogram arms which allow the angle guide to be moved, and locked, in position relative to the bench.

BRIEF DESCRIPTION OF THE DRAWINGS

FIG. 2 is a perspective view of part of a tread and riser pair, seen from the back.

FIG. 4 is a vertical section through part of a staircase made in accordance with the invention;

DETAILED DESCRIPTION OF THE PREFERRED EMBODIMENTS

Figure 1:
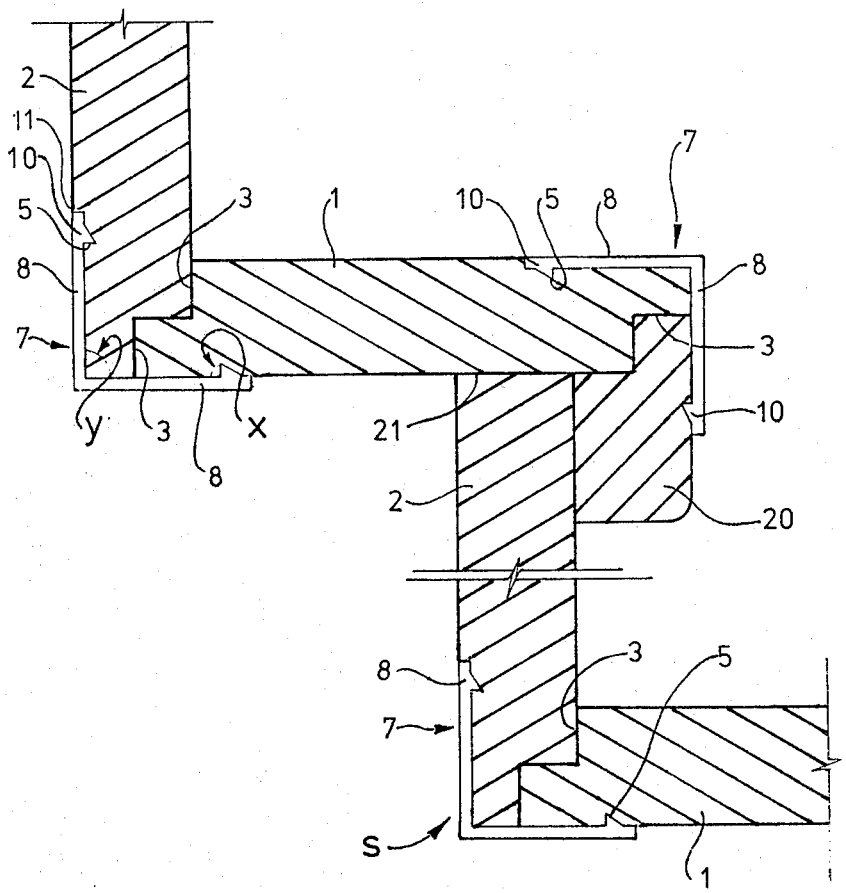
FIG. 1 is a vertical cross-section through part of three steps made in accordance with the method of invention.

Referring to FIGS. 1 and 2 of the drawings, each tread 1 and each riser 2 consists of a slab of suitable material (e.g. wood-based fibreboard) with a rebate 3 cut across the width of one face of the slab and a second rebate diagonally opposite the first rebate 3, cut across the width of the other face of the slab. Each rebate 3 is equal in width to half the thickness of the slab, and effectively removes a portion of square cross-section from the slab. A groove 5, is cut across the width of the slab adjacent each rebate 3, but on the opposite face of the slab.

To make a step, one tread and one riser are arranged at right angles to each other, with the rebate 3 on the tread 1 mating with the rebate 3 on the riser 2 as indicated by arrow S (FIGS. 1 & 2). The tread and rebate are secured in this position by a joining strip 7.

Figure 3:
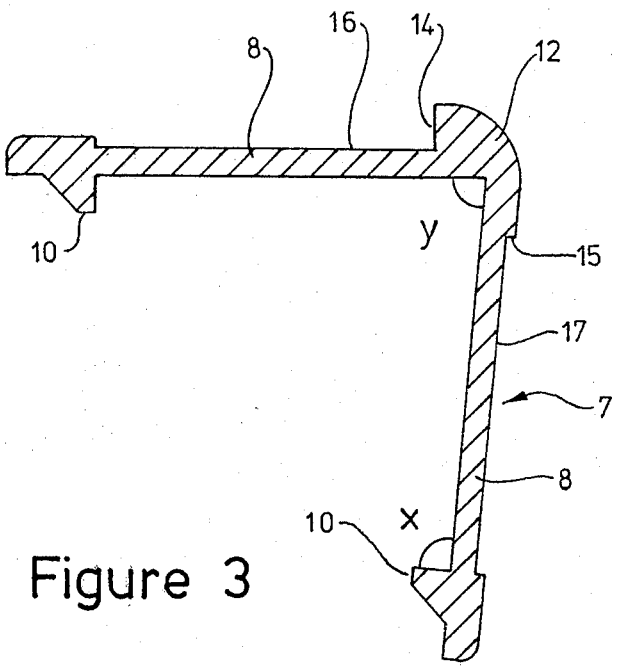
FIG. 3 is a side cross-sectional view of a second type of joining clip.

The joining strip 7 comprises an L-cross-section extrusion (made of an aluminium alloy or other suitably tough, flexible material) and providing two sides 8, inclined to each other at an angle y of about 85°, each side being formed with a flange 10 adjacent the free end thereof, on the inside of the 'L'. Each flange 10 extends along the length of the corresponding side 8, the flange being inclined to the plane of the corresponding side at an angle x which is slightly less than 90°. FIG. 1 shows the simplest form of joining strip. A more sophisticated form is shown in FIG. 3: this form has all the features of the FIG. 1 version but instead of the thickness of the sides 8, being uniform, the thickness is increased at the bend of the 'L' to form a nosing 12. The nosing 12 is rounded on its outer edge and terminates at each side in a face 14, 15 perpendicular to the adjacent surface of the side 8. The nosing 12 is thicker adjacent one of the sides 8 so that the face 14 forms a recess 16 about 2–3 mm high in which thick flooring material such as carpeting can be received. The face 15 forms a shallower recess 17 about 0.5 mm high, in which, for example, a thin layer of flooring can be received. Faces of similar height to face 15 are formed opposite the flanges 10 in each side 8.

Figure 3A:
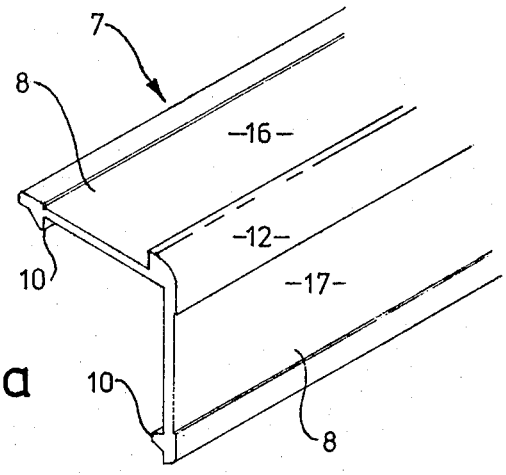
FIG. 3*a* is a perspective view of part of the clip of FIG. 3.

The joining strips of FIGS. 1, 3 and 3*a* are used in the same way: the strip is laid over the corner formed by the mated tread and riser and one of the flanges 10 is engaged with one of the grooves 5 in the tread or riser. The other flange 10 is then forced into the other of the grooves 5 by striking the bend of the joining strip with a mallet. As the second flange 10 engages said groove, the joining strip is sprung apart, increasing the angle between the sides 8 to 90°. Thus the resilience of the joining strip continuously forces the flanges 10 into engagement with the grooves 5, and holds the joint firmly and securely together. Preferably, each groove 5 is widened at one end 11 (FIG. 1) to permit the end of the strip 7 to lie flush with the surface of the tread or riser.

By making the joints in this manner, a series of separate steps may be constructed. To join the steps together the joint between the tread and riser at the top of each riser may be identical to the joint at the base of each riser i.e. the slab forming the riser 2 is identical in shape (although not necessarily in dimensions) with the slab forming the tread 1.

However, to improve the appearance of the stairs, it is preferred to provide the top of each riser with a nosing, which is formed by removing from the top end of each riser slab a strip 20 of sufficient width to include both the rebate 3 and the groove 5 at that end of the slab. The nosing strip 20 is then secured along the top edge 21 of the riser slab, with the edge of the rebate level with, and adjacent, said top edge 21, as shown in FIG. 2. The nosing strip 20 is secured by gluing and/or nailing. The edge of the next tread slab is mated with the riser and nosing strip as shown in FIG. 1 and the joint is secured by a joining strip in the manner described above.

Thus, a series of plain or nosed steps can be constructed rapidly and accurately from a number of identical slabs, each equal in length to the desired width of the staircase and each cut to the width required for the desired tread depth and rise of the staircase.

The above description and drawings refer to rectangular plan tread and riser slabs, forming a straightrun staircase, but it will be appreciated that the same method of construction can be used to make steps for winders or for spiral staircases, using the appropriate shapes for the treads and risers.

To make a straight-run staircase, a series of rectangular-plan steps must be supported by stair carriages: by way of example, we will consider a staircase of less than 1 meter wide, in which a carriage 22 is needed at each side of the staircase.

In accordance with the present invention, each carriage 22 is made by securing spaced cleats 24 to stringer 25. The stringer 25 is a plane parallelogram-shaped sheet of wood or other suitable material, to one side of which the cleats 24 are secured e.g. by stapling. Each cleat 24 must provide two mutually perpendicular surfaces: a horizontal surface 26 and a vertical surface 27 against which the tread 1 and the riser 2 respectively of each step locate in use; and the cleats 24 must be spaced and angled correctly on the stringer 25 to support the steps properly. In plan, each cleat 24 is in the shape of a right-angled triangle, the length 'b' of the hypotenuse being equal to the distance between two consecutive risers. Since the portion 26 of the cleat which supports the tread 1 is always horizontal in use, and the longer sides of the stringer 25 are parallel, it follows that the angle 'a' between the horizontal portion 26 of the cleat and the adjacent edge 28 of the stringer 25 is equal to the angle 'c' between the floor on which the staircase is supported and the adjacent edge 29 of the stringer 25 (i.e. the angle of the staircase).

The number, spacing, and angle of the cleats 24 can be worked out from the geometry of the staircase, knowing the tread and riser dimensions, and the total rise and angle of the staircase. However, for speed and convenience we prefer to provide tables which set out the results of these calculations for a wide range of tread and riser dimensions. Using these tables, once the total rise and run of the staircase and the rise between adjacent treads (i.e. the riser height) have been decided, the number of treads 1 and risers 2 needed, the length of the cleat hypotenuse 'b' and the angle 'a' of the cleats relative to the stringer edge 28 can be read from the tables.

From this information, the required number of treads 1 and risers 2 are selected and cut to size, and the risers cut to provide nosings 20, if desired, as described above. The joining strip 7 (generally provided as very long lengths of extrusion) is also cut into lengths each equal to the width of the treads 1 and risers 2.

In addition, one rudimentary tread only a few centimeters in depth, is cut for the top of the staircase where the tread is joined to the floor of the landing or of the upper storey, and about 18 mm is cut off the height of the lowermost riser, to allow the thickness of the supporting floor from which the staircase rises.

The required number of cleats 24 are then cut, for convenience using a metal template marked with the corresponding tread and riser dimensions. Each cleat 24 is then trimmed to remove the non-right-angled corners, to give the shape shown in FIG. 4. This prevents the edges of the cleat from snagging on the joining strips. Preferably, the reverse of the cutting template is marked to indicate the correct trimming lines. Two stringers 25 are also cut to the correct length, and the cleats 24 are secured to the stringers by e.g. stapling, nailing or gluing. The cleats' positions on the stringers may be calculated and marked in any convenient manner, but preferably a machine of the type shown in FIGS. 5 & 6 is used.

Figure 5:
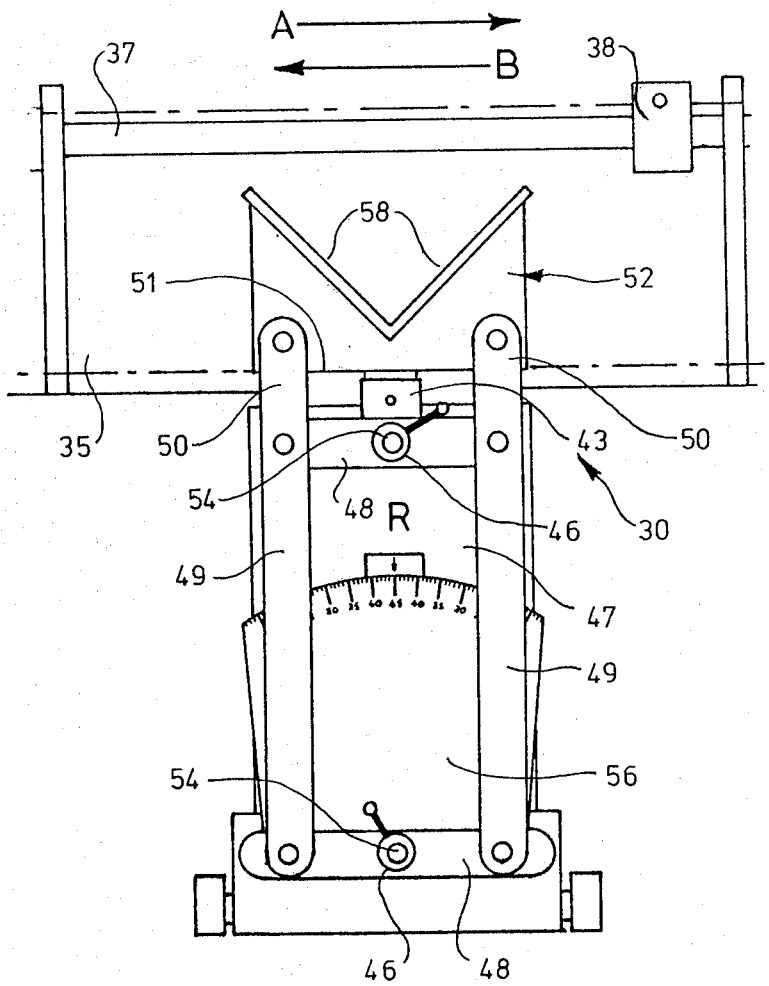
FIG. 5 is a front elevational view of apparatus for making the staircase of FIG. 4.
Figure 6:
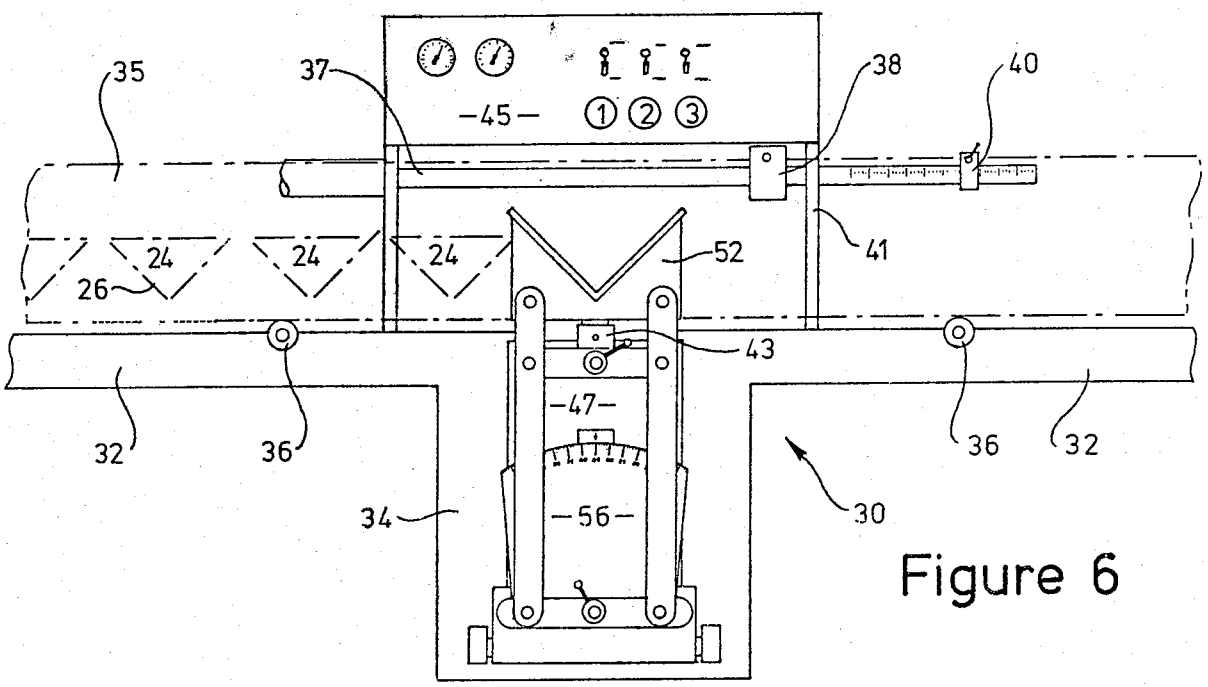
FIG. 6 is a front elevational view of part of the machine of FIG. 5 on a smaller scale.

Referring to FIGS. 5 & 6, the machine 30 comprises a bench 32 in the centre of which pedestal 34 is mounted. The bench 32 is approximately twice the length of the longest stringer to be handled, and provides a surface on which a stringer on edge (35 shown in broken lines) can be supported at a comfortable working height. Said surface is fitted with rollers 36 so that the stringer 35 can be moved along the bench 32 easily.

The pedestal 34 supports a crosshead 37 which carries a clamp 38. The crosshead can reciprocate in the directions of arrows A & B (FIG. 5) carrying the clamp 38 with it. A stop 40 is secured to the crosshead 37 in a predetermined position along its length. The stop 40 engages the wall 41 of the crosshead housing and so limits the travel of the crosshead 37. A scale is marked on the crosshead so that the stop can be positioned accurately.

The sliding clamp 38 is set at a level such that it can grip the upper edge of the stringer 35 resting on the bench 32; a second non-sliding clamp 43 is set at a level such that it can grip the lower edge of said stringer 35.

Both of the clamps 38, 43 can be moved between a 'closed' position in which the clamp grips the stringer on the bench and an 'open' position in which the stringer can slide through the clamp. The clamps are opened and closed, and the crosshead is reciprocated, by any suitable means: mechanical, electrical, hydraulic or pneumatic. A pneumatic system has been found satisfactory, and is the system actually used on the machine shown in FIGS. 5 & 6. Three control switches are mounted on a panel 45 on the pedestal: the first switch (1) opens and closes the protractor clamp (described below); the second switch (2) opens and closes the sliding clamp; and the third switch (3) (a 3-way switch) moves the crosshead forward or back or leaves it stationary.

The second clamp 43 is mounted on a base-plate 47 of a protractor and the whole protractor moves in and out with the clamp 43. The protractor comprises a pair of parallel cross-arms 48 each pivoted in the centre to points 46 on the centre-line of the base plate; and a pair of parallel side arms 49 each pivotally secured between two opposite ends of the cross-arms 48, to form a parallelogram linkage. The upper end of each of the side arms has an extension 50 as a continuation of said said -arm above the upper cross-arm. The free end of each extension 50 is pivoted to an angle guide 52, the base 51 of said angle guide being parallel to the cross-arms 48. The pivots 46 can be locked rigid with lock nuts 54. Thus, the side arms can be pivoted to any of a range of angles relative to the centre-line of the base plate 47, and locked to a selected angle by tightening the lock-nuts 54.

The parallelogram linkage ensures that the angle between the base 51 of the angle-guide 52 and the centre-line of the base-plate 47 (which is vertical) is always the same as the angle between the cross-arms 48 and said centre line. A protractor scale 56 is mounted on the lower cross-arm 48, and moves with said cross arm 48 relative to a reference point R marked on the centre-line of the base-plate. The protractor scale 56 is marked so that the position of point R in relation to the scale gives the angle between the lower edge of the stringer 35 supported on the bench 32 and the tread-supporting portion 26 of a cleat 24 positioned in the angle-guide 52. The angle-guide 52 provides two mutually perpendicular support faces 58 each inclined at 45° to the base 51 of the angle-guide 52. Thus, when the angle guide 52 and parallelogram linkage are pivoted to a position in which the angle-guide base 51 and the cross-arms 48 are horizontal, each of the support faces 58 will be at an angle 45° to the horizontal and hence to the lower edge of a stringer supported on the bench 32. The protractor scale 56 is symmetrical and is centred at 45° so that when said cross-arms 48 are horizontal, point R is opposite the central 45° mark on the scale 56. On each side of the centre, the protractor scale is marked down to 20°. The portion of the scale on the right-hand side (as seen in FIGS. 5 & 6) is used when a stringer for the left-hand-side of a staircase (viewed from the bottom of the staircase) is being prepared; the left-hand scale portion is used when a right-hand-side stringer is being prepared.

The above-described machine 30 is set up for a particular staircase as follows: with the help of the scale on the crosshead, the stop 40 on the cross-head 37 is positioned so that the distance which the cross-head 37 can reciprocate is equal to the hypotenuse of each cleat 24 (i.e. the distance 'b' between consecutive risers). Next, the lock-nuts 54 are loosened and the angle-guide 52 is pivoted until the point R registers against the protractor scale 56 at the desired angle of inclination of the angle-guide faces 58 to the lower edge of the stringer. The lock-nuts 54 are then tightened to fasten the angle guide 52 in the correct position.

The stringer 35 to be prepared is then placed on the right-hand-side of the bench, with one end of the stringer behind the angle guide 52, and extending beyond the angle guide 52 by an amount sufficient to allow the necessary joinery work to be done on the end of the stringer. The protractor clamp 43 is then closed, bringing the angle guide 52 hard against the stringer 35. A cleat 24 is placed in the angle guide 52 with the tread-supporting portion 26 of the cleat 24 against the left-hand face of the angle guide 52, and the cleat 24 is stapled in place by the operator, using a manually-operated staple gun. The operator then closes the sliding clamp 38, opens the protractor clamp 43, and sets the crosshead control switch to move the stringer in the direction of arrow B by a distance equal to the cleat hypotenuse, as described above. Next, the protractor clamp 43 is closed, the sliding clamp 38 opened, and the crosshead control switch reversed to move the crosshead 37 in the direction of arrow A. While the crosshead 37 is moving, the operator positions the next cleat 24 in the angle guide 52 and staples it in place. This sequence is repeated until all the cleats 24 have been secured to the stringer 35. The right-hand-side stringer is prepared in the same way, except that the cleat angle is set on the left-hand-side of the protractor scale. If screwholes are required in the stringer, these are drilled immediately before or after stapling the cleats, through holes (not shown) in the angle guide 52.

It will be appreciated that the above machine may be made fully automatic if desired.

When the two stair carriages have been prepared as described above, the staircase is assembled as follows: all the treads 1 and risers 2 are assembled into steps as shown in FIG. 2, and the carriages are supported spaced the correct distance apart. A step is secured in place at each end of the carriages, and then the intermediate steps are secured. Each step is secured to the carriage by nailing through the tread and riser surface onto the underlying cleat 24 and/or by screwing the sides of the tread and riser onto the stringer. Next, the joining strips 7 are applied to the noses of each step, completing the staircase.

The staircase can be moved into its final position either before or after the intermediate steps are secured.

The underside of the staircase may be closed off by securing a trimmer board (not shown) between the stringers. Preferably the trimmer board is secured to the portion of each cleat 24 which projects slightly below the line of the staircase. The use of such a trimmer board not only improves the appearance of the staircase but also strengthens it.

If the staircase is to be broken by a landing the landing is constructed as an independent platform (according to known techniques) with separate straightrun staircase on each side of the landing.

If the staircase is wider than 1 meter and/or is required to be stronger than usual, one or more intermediate carriages are placed beneath the steps, between the carriages at each side of the staircase. The or each intermediate carriage conveniently is a 'rough carriage' and the steps are secured to it in known manner.

What I claim is:

1. A method of making a step for a closed-tread staircase comprising the steps of:

providing a slab for the tread and a slab for the riser, each slab having formed thereon:

a first rebate across the width of one face of the slab, along one edge of said slab; a second rebate across the width of the other face of the slab, along the opposite edge of said slab; a first groove parallel to and adjacent said one edge on said other face of the slab; and a second groove parallel to and adjacent said opposite edge on said one face of the slab;

forming a step comprising a tread and riser pair, said pair being formed by mating one of the rebates on one slab with one of the rebates on the other slab to form a joint, said rebates being shaped and dimensioned such that the mated rebates fit closely to form a joint of predetermined angle;

providing a joining strip which is V-shaped in cross section and has two sides, each formed with a flange adjacent the outer free end thereof protruding from the inside face of each side and the angle between said flange surface facing the inside corner of the V and the plane of said corresponding side being equal to or less than 90°;

and securing said joint with said joining strip by engaging the flange on one side of the joining strip with the groove adjacent one side of the joint and forcing the flange on the other side of the joining strip into engagement with the groove adjacent the other side of the joint; the angle between the two sides of the joining strip when said strip is engaged with the joint being equal to the angle of the joint.

2. The method as claimed in claim 1 wherein the riser is identical in shape, but not necessarily identical in dimensions, to the tread.

3. The method as claimed in claim 1 wherein the riser is formed by carrying out between steps 1 and 2 the steps of:

removing from an edge of the riser a strip wide enough to include the rebate and the groove adjacent said edge;

securing said strip to he non-grooved face of the slab along the edge from which the strip has been removed, such that the surface of the rebate on the strip is flush with said edge.

4. The method as claimed in claim 1 or claim 3 wherein the tread slab and the riser slab are rectangular in plan.

5. The method as claimed in claim 1 or claim 3 wherein the tread is a winder.

6. The method as claimed in claim 1 wherein said predetermined joint angle is 20°.

7. The method as claimed in claim 6 wherein each rebate is L-shaped in cross-section, the angle between the sides of the rebate being approximately 90° and said sides each being equal in width to half the slab thickness.

8. The method as claimed in claim 1 wherein said predetermined joint angle is less than 90°.

9. The method as claimed in claim 1 wherein said predetermined joint angle is greater than 90°.

10. A method of making a closed-tread staircase comprising the steps of:

forming a plurality of steps using the method as claimed in any one of claims 1, 2, 3, 6, 7, 8 or 9;

joining said steps together to form a series of steps by mating the rebate at the free end of a tread of one step with the rebate at the free end of a riser of another step to form a joint of predetermined angle, and securing said joint with a joining strip by engaging the flange on one side of the joining strip with the groove adjacent one side of the joint and forcing the flange on the other side of the joining strip into engagement with the groove adjacent the other side of the joint; the angle between the two sides of the joining strip when said strip is engaged with the joint being equal to the angle of the joint.

supporting said series of steps upon two or more spaced stair carriages, and securing said series of steps thereto.

11. The method as claimed in claim 10 wherein each stair carriage comprises a stringer with a series of cleats secured to one surface thereof, said cleats being spaced apart so that one cleat corresponds to each step, and each cleat providing a horizontal and a vertical support surface to support the edge of a tread and a riser respectively.

12. The method as claimed in claim 11 wherein each cleat is in the stage of a triangle with the corners adjacent the hypotenuse cropped.

13. The method as claimed in claim 10 further comprising securing a trimmer board between adjacent stair carriages, the plane of said trimmer board being perpendicular to the plane of each stringer.

14. A closed-tread staircase constructed by the method as claimed in any one of claims 10–13.

15. A kit of parts for a closed-tread staircase, comprising: a plurality of steps constructed by the method as claimed in any one of claims 1, 2 or 3, and two or more stair carriages each comprising a stringer having a series of cleats secured to one surface thereof, said cleats being spaced apart so that one cleat corresponds to each step and each cleat provides a horizontal and a vertical surface to support the tread and riser respectively of a step.

* * * * *